US006279780B1

(12) United States Patent
Rousselet

(10) Patent No.: US 6,279,780 B1
(45) Date of Patent: Aug. 28, 2001

(54) PACKAGING FOR PASTY LIQUID PRODUCT WITH IMPROVED DEGREE OF EMPTYING

(75) Inventor: Guilhem Rousselet, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/624,550

(22) Filed: Jul. 24, 2000

(30) Foreign Application Priority Data

Jul. 23, 1999 (FR) ..... 99 09616

(51) Int. Cl.[7] ..... B65D 35/08
(52) U.S. Cl. ..... 222/107; 222/92
(58) Field of Search ..... 222/92, 107, 206, 222/215, 212, 490, 494, 575

(56) References Cited

U.S. PATENT DOCUMENTS 2,441,649 * 5/1948 Sprague ..... 222/92
2,898,007 * 8/1959 Gassaway ..... 222/215
3,158,110 * 11/1964 Ross ..... 222/107

FOREIGN PATENT DOCUMENTS

| | | |
|---|---|---|
| 195 38 338 A1 | 4/1997 | (DE) . |
| 0 641 719 A1 | 3/1995 | (EP) . |
| 0 845 421 A1 | 6/1998 | (EP) . |
| 732761 | 6/1955 | (GB) . |
| 830695 | 3/1960 | (GB) . |
| 6402617 | 9/1964 | (NL) . |

* cited by examiner

*Primary Examiner*—Kevin Shaver
*Assistant Examiner*—Patrick Buechner
(74) *Attorney, Agent, or Firm*—Oblon, Spivak, McClelland, Maier & Neustadt, P.C.

(57) ABSTRACT

Packaging for a product, especially a pasty liquid, includes: a reservoir for the product, formed by a compressible body, surmounted by a shoulder; a rigid neck with an X-axis, joined to the shoulder, and provided with a dispensing passage, wherein a free edge of the shoulder delimits an aperture communicating with the interior of the reservoir; and a cap, able to close the aperture. The neck includes at least two slits extending over substantially the entire height of the neck and opening out into the aperture.

21 Claims, 3 Drawing Sheets

PACKAGING FOR PASTY LIQUID PRODUCT WITH IMPROVED DEGREE OF EMPTYING

CROSS-REFERENCE TO RELATED APPLICATIONS

The present application claims priority under 35 U.S.C. §119 to French Patent Application No. 9909616 filed on Jul. 23, 1999, which application is hereby incorporated by reference.

BACKGROUND OF THE INVENTION

1. Field of the Invention

The present invention relates to a packaging for a product of pasty liquid consistency contained in a compressible receptacle allowing the emptying of almost all of the product which it contains.

2. Discussion of the Background

Thus, frequently, the user wishing to employ a product of more or less viscous consistency contained in a compressible receptacle of the bottle, bottle-tube or tube type, notes that at the end of use there is still some product in the receptacle. Such a residual product is impossible to get out simply by compressing the receptacle. Generally, the degree of retrieval of product packaged in such a receptacle depends on the rheology of the product, and is from around 85% to 90% of all of the product.

It has been noted that certain consumers seek to open the receptacle with the aid of a cutting tool, so as to access the product remaining inside, especially when dealing with a cosmetic product whose price is often high.

Various solutions have already been proposed for minimizing the degree of product remaining in the receptacle at the end of use.

Thus, WO-A-96/26120 discloses a flexible tube finished with a dispensing head consisting of a concave shoulder. A dispensing neck emerging from the centre of the concavity can be blocked off by a closure cap. This packaging has the drawback however that, in particular in the case of tubes, bottles or bottle-tubes made from a plastic and comprising an orifice of undeformable nature, a relatively considerable quantity of product remains inaccessible in the head of the reservoir. Furthermore, the configuration of the tube head proposed requires an excessively long neck, trapping further product and having a rather unaesthetic appearance. Such a configuration may hardly be suitable for a tube for packaging product, especially cosmetic product, and is totally inappropriate for the production of bottles or bottle-tubes.

Furthermore, EP-A-0 845 421 discloses a dispensing head mounted on a compressible receptacle, this head comprising a plurality of zones of reduced thickness allowing diametral squeezing of the dispensing head. Although this dispensing head makes it possible to compress the product-dispensing channel, it cannot solve the problem of using almost all of the product. Indeed, some residual product always remains trapped in the vicinity of the substantially rigid shoulder, formed between the head of the tube and its flexible side wall.

Moreover, GB-A-0830695 describes a bottle furnished with a dispensing spout which can be blocked off with the aid of a screw-on cap. The spout comprises two incisions parallel to a central axis of the spout, which are able to separate in response to the thrust of the product to be dispensed. This device does not make it possible to compress the product-dispensing channel, and cannot solve the problem of using almost all of the product.

Furthermore, NL-A-6 402 615 relates to a device making it possible to reduce an accidental internal overpressure of a bottle. For this purpose incisions of small depth, for example in the shape of a <<V>>, are made on the free edge of the bottle neck. An elastic washer is arranged at the bottom of a screw stopper in such a way as to block off the said bottle neck, in the closed position of the bottle. When an overpressure occurs, the overpressure prevailing inside the bottle separates the washer from the zone of the incisions, allowing the overpressure to escape. These incisions are entirely unable to solve the problem addressed by the present invention.

SUMMARY OF THE INVENTION

The invention aims to provide a novel packaging which makes it possible to access the product retained at the end of use, especially under the shoulders with which a compressible reservoir is provided, and which, in particular, cannot be dispensed by compressing the body of the reservoir.

Hence, the invention provides a packaging for product, for example a product of pasty liquid consistency, comprising:

- a reservoir for the product, formed by a compressible body surmounted by a shoulder;
- a rigid neck with a longitudinal axis, joined to the said shoulder and provided with a product-dspensing passage, a free edge of which neck delimits an aperture communicating with the interior of the reservoir; and
- a cap, able to close the said aperture.

According to the invention, the said neck comprises at least two slits extending over substantially the entire height of the neck and opening out into the said aperture. Thus, when a radial compression is exerted on two diametral zones of the shoulder, the said slits separate in such a way as to bring the said compression zones together and to favour the expulsion of the residual product located in the vicinity of the shoulder.

Furthermore, the said slits are able to open up into a V-shape. This arrangement allows the user to access the residual product trapped for example in the neck and underneath the shoulder. In this way on the one hand the user can by compressing the reservoir expel a part of the product remaining inside the reservoir. On the other hand, it allows neck opening such that the user can access the interior of the reservoir and collect the remainder of the product, with the aid of an implement of the spatula or cotton-bud type, or with the aid of a finger. Trials carried out by the applicant have shown that, in this way, the degree of retrieval of the product can be increased. According to the trials, the degree of retrieval is between around 95% and around 97% of the total quantity of product, this being a very satisfactory result.

Moreover, this arrangement allows the user to verif visually the degree of emptying of the reservoir. This arrangement makes it possible, furthermore, to reduce the volume occupied by the reservoir at the end of use, and therefore to compact it and to minimize its bulk.

Advantageously, the present packaging is configured so that the said radial compression can be performed perpendicularly to the orientation of at least one of the slits. This arrangement thus makes it possible to be able to put the slits back into an adjoining position, and to favor the repositioning of the cap on the neck of the reservoir.

Preferably, the neck exhibits at least two diametrically opposed slits.

Among the products intended to be packaged in the device, according to the present invention, one may mention, in particular, beauty creams, foundations, gels, glues or mastics, artist's paints, food products such as mayonnaise, etc.

Preferably, the reservoir is shaped as a tube, as a bottle-tube or as a bottle. This reservoir can be made from one or more thermoplastic materials or, for example in the case of a tube, from a flexible metal, such as aluminum or tin.

The term "tube" designates a receptacle of generally cylindrical body, a first end of which forms a bottom following a line of closure, obtained in particular, through pinching followed by folding or by welding. The second end is integral with a dispensing head comprising a shoulder furnished with a neck and provided with a blockable dispensing orifice.

The term "bottle-tube" should be understood to mean a receptacle of non-cylindrical right cross section, the bottom of which is formed by a line of closure, obtained in particular from molding or through pinching followed by folding or by welding. The side away from the bottom forms a dispensing head, comprising a shoulder furnished with a neck and provided with a blockable dispensing orifice.

The term "bottle" designates a receptacle whose body includes an upper end comprising a shoulder surmounted by a neck provided with a blockable dispensing orifice. The opposite side consists of a flat bottom, allowing the bottle to stand upright on a support.

Advantageously, in particular for economic reasons, it is preferred to produce the reservoir from a thermoplastic such as high- and low-density polyethylenes, polypropylene, thermoplastic polyesters (polypropylene terephthalate, polybutylene terephthalate, etc.) or polyvinyl chloride.

According to a variant, especially when dealing with a tube, the shoulder can be made from a flexible material, overmolded together with the neck, as appropriate, onto the body of the reservoir. This body of the reservoir can be constructed from a plastic or plastic/metal multilayer complex.

According to an interesting aspect of the invention, the said shoulder comprises at least one zone of preferential folding, consisting in particular of at least one zone of lesser thickness. This zone of preferential folding extends, advantageously, from at least one of the said slits, between the said neck and a peripheral edge of the shoulder.

Preferably, the said zone of preferential folding extends over the entire width of the shoulder. More particularly, the said zone of preferential folding can be situated in a plane containing two diametrically opposed slits of the said neck.

According to another possibility, the zone of preferential folding extends right around the base of the neck.

Indeed, the production of at least one zone of preferential molding on the shoulder favors the diametral compression of the upper portion of the receptacle, at the end of use. Such a zone of preferential folding can be produced as a straight, bent or curved line. Advantageously, such a zone of preferential folding can be produced by weakening a portion of reduced thickness of the shoulder. In this case, the portion of reduced thickness can take the form of a groove, made on the exterior f ace and/or on the interior face of the shoulder.

Advantageously, a plurality of zones of preferential folding are made on the shoulder, possibly of different types.

According to a preferred embodiment, the slits are obtained by cutting out, with the aid of a blade, especially of small thickness. In this case, the slits are substantially adjoining, in the position with the cap mounted on the neck. Advantageously, the slits exhibit an axial orientation.

Alternatively, it is possible to make the slits during the molding of the neck, in which case the slits are not entirely adjoining. However, a reservoir comprising a neck with slightly open slits may be suitable for packaging a relatively viscous or pasty product.

Advantageously, the neck comprises fixing means, able to cooperate with complementary means formed on the cap. Generally, one prefers closure by screwing comprising a helical thread, but a snap-fastening system or any other appropriate system may be equally suitable.

According to a particular embodiment of the invention, the packaging can be designed to be restoppable, after opening the neck by separating the edges delimiting the slits. This case can arise when a considerable degree of product is retained underneath the shoulder, sufficing for several applications.

If the user wishes to reclose a receptacle whose neck has been opened by previous separation of the edges of the slits, it is then sufficient to bring these edges together by pinching. Owing to the mechanical properties of the constituent material of the neck, as a general rule, the slits do not close up again completely. However, after fitting the closure cap, the slits reassume their initial adjoining or near-adjoining form, since they are tightened by the threading of the cap.

To facilitate the refitting of the closure cap, advantageously, the neck exhibits a free end, provided with an external chamfer. Moreover, the means of complementary fixing of the cap, intended to be mounted on the said neck, may comprise a flared free end, favoring the engagement of the threading of the cap onto the thread of the neck.

To further facilitate the refitting of the closure cap, the neck can exhibit a frustoconical exterior profile, of increasing cross section in the direction of the reservoir, the cap exhibiting a complementary interior profile. When a screw system is envisaged, in this configuration, the thread of the neck and that of the corresponding cap exhibit a helix, the diameter of whose turns decreases in the direction of the aperture.

In the case of a tube or of a bottle-tube, the reservoir comprises a bottom, obtained for example by molding or by pinching, then thermowelding, of a free end of the body on the side away from the neck.

In the case of a bottle-tube, advantageously one at least of the slits of the neck is oriented along a line of closure of the bottom.

When dealing with a non-cylindrical receptacle, for example one which is oval, whose cross section right with its longitudinal axis exhibits a major axis and a minor axis, advantageously, one at least of the slits is oriented along the major axis of the said cross section.

BRIEF DESCRIPTION OF THE DRAWING

Other characteristics and advantages of the invention will emerge from reading the detailed description which will follow, of several illustrative and non-limiting exemplary embodiments of the invention, and from examining the appended drawings in which.

DETAILED DESCRIPTION OF THE PREFERRED EMBODIMENTS

Figure 1:
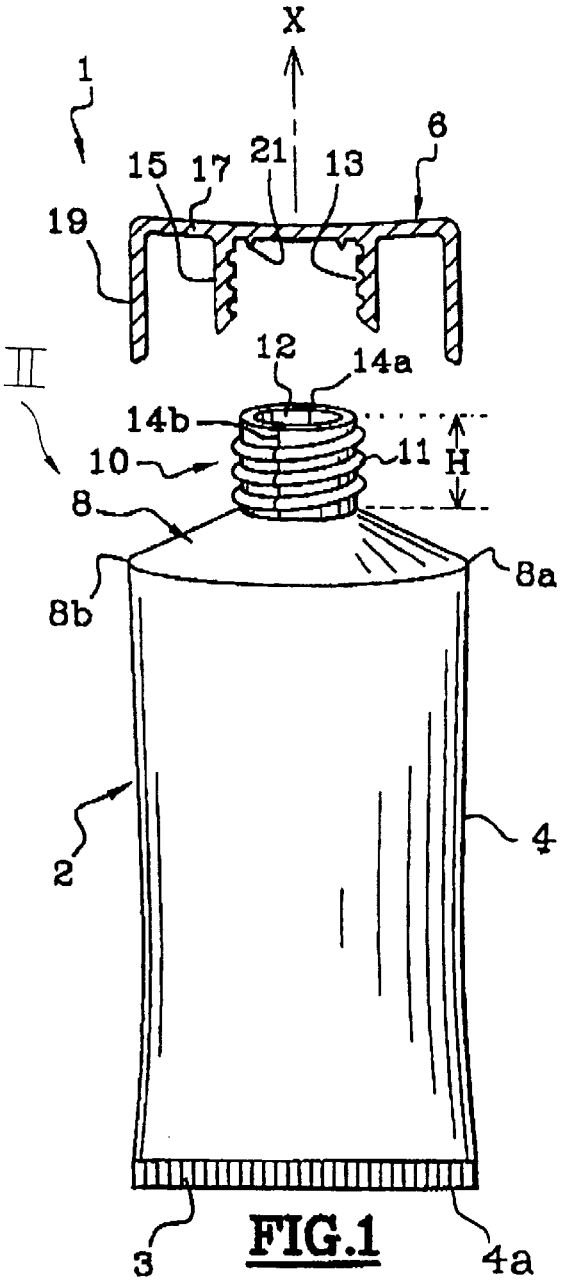
FIG. 1 is a diagrammatic view, in elevation, of a packaging assembly according to a first embodiment of the invention, representing a flexible tube.
Figure 2:
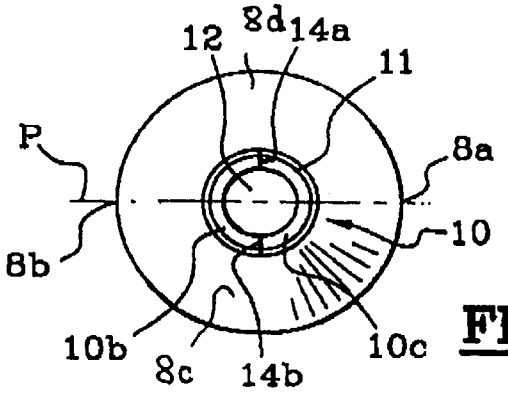
FIG. 2 represents a view from above along the direction II—II of FIG. 1.
Figure 3:
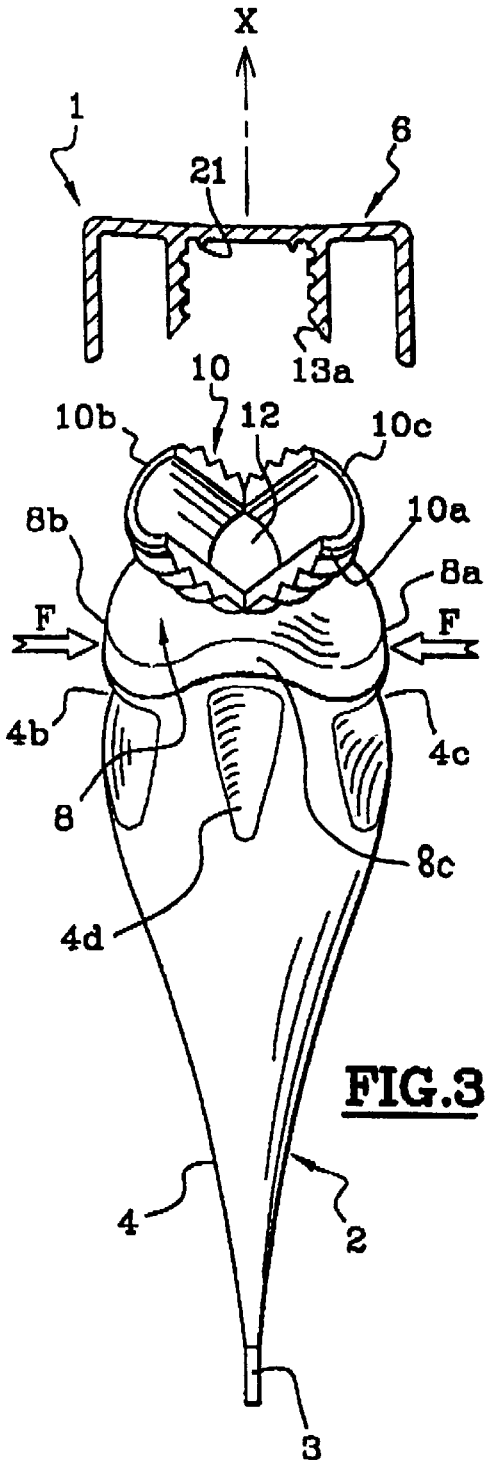
FIG. 3 presents a perspective view of the assembly in accordance with FIG. 1, at the end of use.

Represented in FIGS. 1 to 3 is a packaging assembly 1 consisting of a reservoir formed by a tube 2 and of a cap 6. The tube 2 comprises a body 4 which is substantially cylindrical in its upper portion. This upper portion is joined to a frustoconical shoulder 8, which shoulder is surmounted by a neck 10. The neck 10 is provided with an exterior thread, able to cooperate, in the closed position of the assembly, with a complementary thread 13 of the cap 6. The free end of the neck 10 comprises a chamfer 10*a,* the roie of which will be explained hereinafter. The neck is traversed by a central dispensing channel 12, a free edge of which delimits a dispensing aperture.

The thread 13 of the cap is made inside a first cylindrical skirt 15, integral with a cylindrical panel 17, forming the upper face of the cap. The free end 13*a* of the skirt 15 is flared. The edge of the panel 17 is joined, in its turn, to a second skirt 19, concentric with the first, and whose diameter corresponds substantially to the diameter of the tube at the level of the shoulder. An annular bead 21, situated inside the first skirt 15, serves as leaktight seal when screwing the cap onto the tube.

The tube 4 is closed by a straight bottom 3, along a line of closure obtained by pinching, then welding or by folding the lower end 4*a* of the body 4.

The tube 2 is flexible, that is to say compressible in the zone of the body 4, whilst the shoulder and the neck are substantially rigid, due to a greater thickness of material as compared with the thickness of the material forming the body 4. The difference in rigidity between the body and the neck (or the shoulder) can result, also, from the choice of the nature of the materials, when making a complex tube from two different materials. Preferably, the tube is made from polyethylene or from another similar thermoplastic. More conventionally, it can be made from aluminum or from tin. The body 4, as appropriate, can be made as a multilayer, for example plastic/metal/plastic, structure.

On account of the structure just described, it follows that a product packaged in such a tube cannot be expelled 100%. This is because after successive compression of the tube, at the end of use, a relatively considerable degree of product remains in the neck, and also underneath the shoulder 8, which in general is difficult to deform, or can only be deformed partially. Indeed, therefore, up to 15% of the product may remain trapped in the tube.

According to the invention, a means is provided for improving the degree of emptying of the tube. Thus, by slitting the neck 10 in the manner described hereinbelow, two objectives may be achieved. Firstly, the shoulder may be rendered more flexible and thus the tube may be further compressed in its upper portion. Secondly, the dispensing orifice may be widened, in such a way as to remove, either with a finger, or with the aid of an implement of the spatula or cotton-bud type, a major part of the trapped product. Additionally, this arrangement makes it possible to verify, visually, the degree of emptying. Moreover, it makes it possible to compact the tube at the end of life, and hence to minimize its bulk.

According to the invention, to improve the degree of emptying of the tube, at least two slits are made in the neck, extending substantially over the entire height of the neck and opening out into the aperture of the receptacle. Advantageously, the number of slits is 2, 3 or 4, distributed regularly over the neck. Preferably, at least two diametrically opposed slits are made.

As may be seen in FIGS. 1 to 3, two diametrically opposed slits 14*a*, 14*b* have been made. Thus, two compression zones 8*a*, 8*b* are defined in the vicinity of the shoulder 8 by a plane P (FIG. 2), passing through the axis X and perpendicular to a plane passing through the slits 14*a*, 14*b*.

The effect of compressing the tube at the level of the zones 8*a* and 8*b* is illustrated in FIG. 3. It may be seen that compression of the shoulder, symbolized by the arrows F, causes the walls of the body to move closer to one another in the zones 4*b* and 4*c,* or even for them to come into contact. Simultaneously, bumps 8*c,* Bd (see also FIG. 2) are formed on the shoulder and a concave depression 4*d* is formed in the wall of the body 4. During compression, the neck 10 folds into two parts 10*b*, 10*c* through the opening of the V-shaped slits. In this way, the aperture 12 of the neck widens, facilitating access to the interior of the tube, with a view to removing the trapped residual product.

At this juncture, when the tube still contains enough product for several applications, it is desirable to reclose the tube. For this purpose, by pressing on the zones 8*c*, 8*d*, and/or 10*b* and 10*c,* the two parts 10*b*, 10*c* move substantially closer to one another. By placing the flared end 13*a* of the cap with slight axial pressure on the chamfered edge 10*a* of the neck, the thread 11 of the neck engages in the thread 13 of the cap 6. After screwing the latter fully onto the tube, the slits are tightened, in such a way as to obtain leaktight closure of the assembly.

Advantageously, the slits are made by vertical slicing, for example with the aid of a blade of small thickness, alternatively, the slit can be obtained by molding and exhibits, in this case, a small width, sufficient to ensure acceptable leaktightness for the packaging of a pasty product.

To improve the capacity of the shoulder 8 to deform, one or more zones of reduced thickness may be provided on the shoulder. These zones of reduced thickness can take the form of a wider or narrower groove of appropriate depth. This zone can be made on the lower face and/or on the upper face of the shoulder. FIGS. 4 to 8 represent embodiments thereof.

Figure 4:
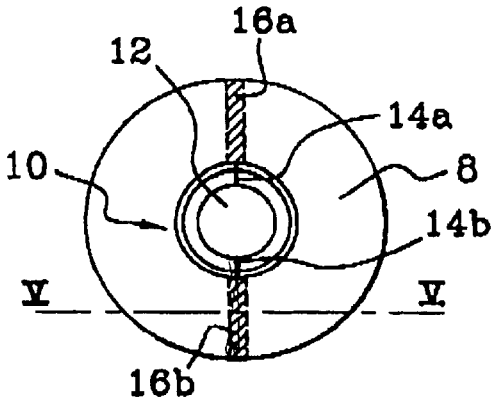
FIG. 4 is a diagrammatic view from above, according to another embodiment.
Figure 5:
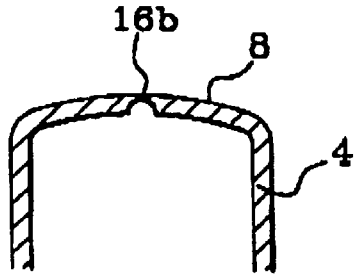
FIG. 5 is a longitudinal slice through the line V—V of FIG. 4.

Thus, FIGS. 4 and 5 illustrate zones of reduced thickness 16*a*, 16*b*, forming an internal groove (see FIG. 5). These grooves extend radially in line with the slits 14*a*, 14*b*.

Figure 6:
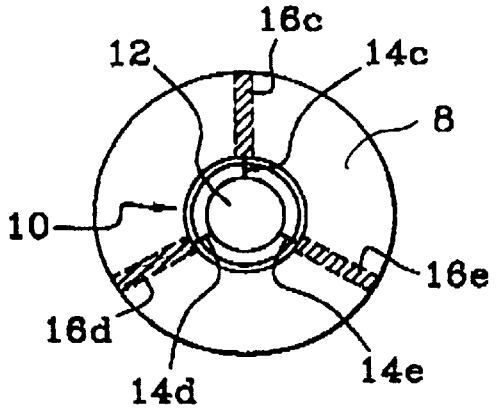
FIGS. 6 to 8 are diagrammatic views from above, according to other embodiments.

FIG. 6 shows a neck 10 comprising three slits 14*c*–14*e* spaced 1200 apart. The slits are extended over the shoulder by three radial zones of reduced thickness 16*c*–16*e*.

Figure 7:
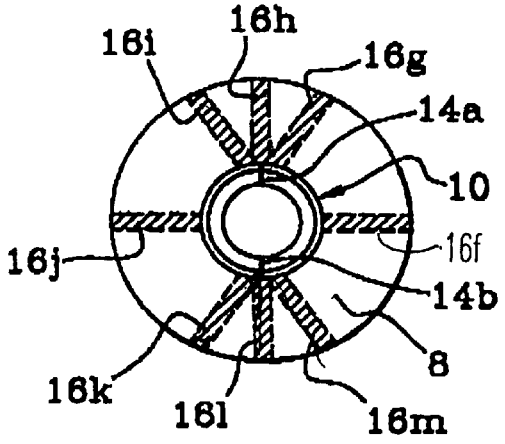

According to FIG. 7, with each slit 14*a*; 14*b* there are associated three zones which diverge from one another, of reduced thickness 16*g*–16*i*; 16*k*–16*m*. Two additional zones 16*f*, 16*j* are arranged perpendicularly to the orientation of the slits 14*a*, 14*b*.

Figure 8:
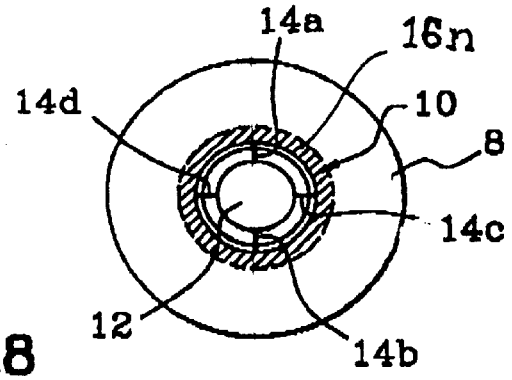

FIG. 8 shows a neck 10 surrounded, over the shoulder 8, by an annular zone 16*n* of reduced thickness. The neck 10 includes four slits 14*a*–14*d* spaced 900 apart.

Figure 9:
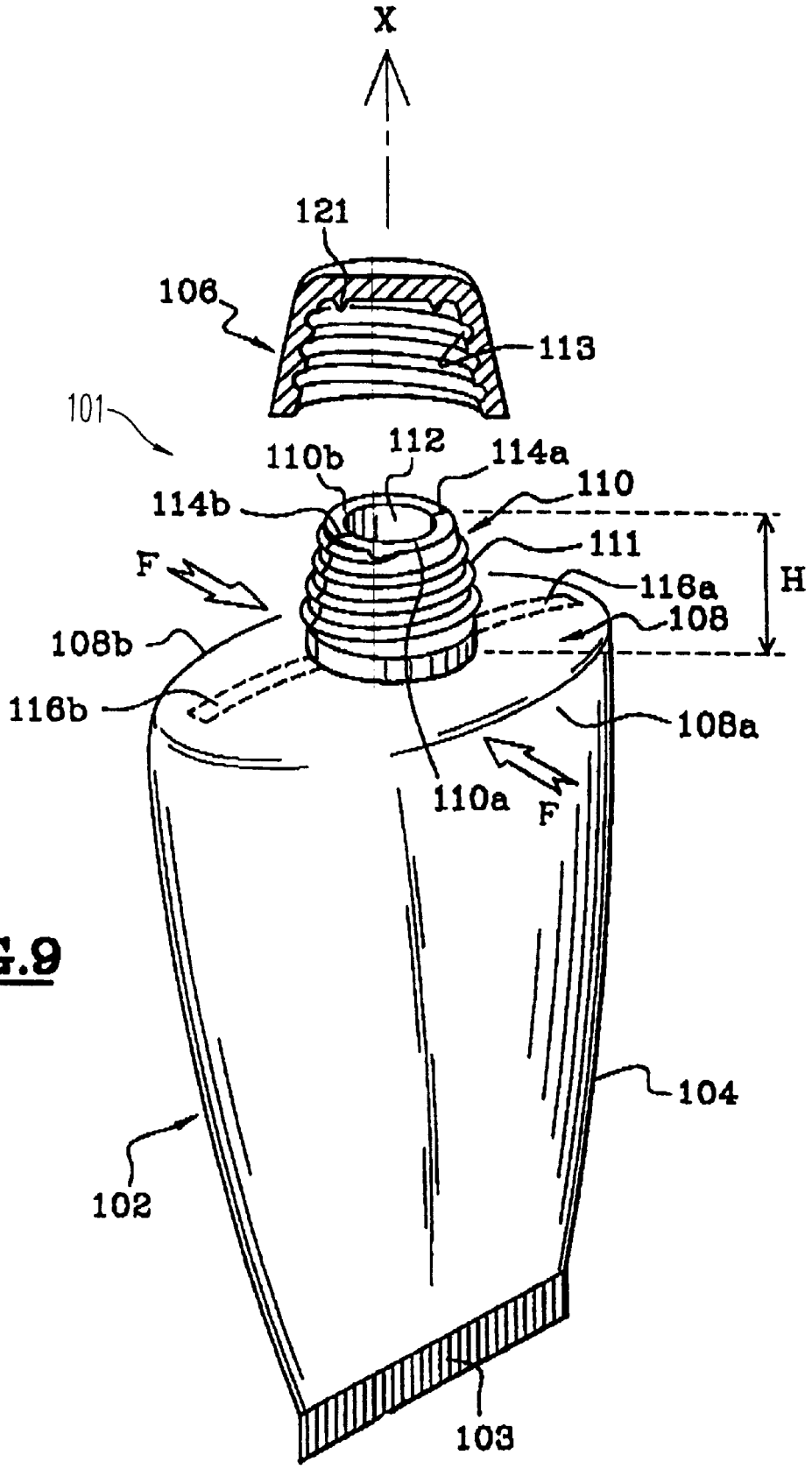
FIG. 9 is a diagrammatic view, in elevation, of a packaging assembly, according to yet another embodiment of the invention, representing a flexible bottle-tube.

Of course, the various configurations of the slits, as well as the various zones of reduced thickness, may be combined at will, Represented in FIG. 9 is a bottle-tube 101. The various parts of this figure bear the references of the corresponding parts of FIG. 1, plus 100. They will only be briefly described again.

The bottle-tube 101 includes a reservoir 102 formed of a body 104 and provided with a neck 110, a closure cap 106 being provided, in such a way as to be fitted to the neck. The body 104 comprises a closed bottom 103, following a closure line.

The body 104 exhibits a substantially oval right cross section, exhibiting a minor axis and a major axis. According to FIG. 9, the body 104 is exhibited according to the minor axis.

On the side away from the bottom, the body 104 forms a shoulder 108, on which the neck 10 is situated. This neck exhibits a frustoconical general exterior shape, provided with a helix-shaped threading bead ill able to cooperate with a complementary thread 113 provided inside the cap 106. It will be observed that, for this purpose, the cap exhibits a frustoconical general shape also. The neck 110 includes a dispensing channel 112 communicating with the interior volume of the reservoir 102.

The neck 110 is provided with two diametrically opposed axial slits 114*a*, 114*b* extending over the entire height H of the neck, thus defining two halves 10*a* and 10*b*.

The shoulder 108 can be provided with several zones of reduced thickness 116*a*, 116*b*. of the kind of those described with reference to FIGS. 4 to 8.

The manner of operation of the packaging 101 is similar to the manner of operation of the packaging of FIG. 1. By pressing on the shoulder in the direction of the arrows F along the minor axis of the oval cross section, the user causes the pressing zones 108*a*, 108*b* to move closer to one another. Simultaneously, the two halves 110*a*, 10*b* of the neck separate into a <<V>> so as to widen the aperture cross section of the neck 110, in a manner similar to the configuration illustrated in FIG. 3. The residual product imprisoned in the dispensing channel 112 and underneath the shoulder 108 can then be removed by the user, as described earlier.

When the user wishes to reclose the reservoir 102, he brings the two halves 110*a*, 110*b* of the neck together. The thread 111 engages easily in the threading 113 by virtue of the conicity of the neck 110 and of the cap 106. At the end of the screwing of the cap, the slits become adjoining and leaktight restopping of the reservoir is obtained. As compared with the embodiment illustrated in FIGS. 1 to 3, the conical configuration of the neck and of the cap, according to FIG. 9, facilitates the engaging of the cap on the neck and minimizes the screwing force, especially at the end of the cap screwing travel.

In the foregoing detailed description, reference was made to preferred embodiments of the invention. It is obvious that variations may be made thereto without departing from the spirit of the invention as claimed hereinbelow.

What is claimed as new and desired to be secured by Letters Patent of the United States is:

1. A packaging for a product, especially a pasty liquid, comprising:

a reservoir for the product, formed by a compressible body surmounted by a shoulder;

a rigid neck with an axis, joined to said shoulder and provided with a dispensing passage, a free edge of which neck delimits an aperture communicating with an interior of said reservoir; and a cap, able to close said aperture; characterized in that said neck includes at least two slits extending over substantially an entire height of said neck and opening out into said aperture.

2. The packaging according to claim 1, wherein said neck exhibits at least two diametrically opposed slits.

3. The packaging according to claim 1, wherein said reservoir is any one of a bottle, a bottle-tube, and a tube.

4. The packaging according to claim 1, wherein said reservoir is made from any one of high-density polyethylene, low-density polyethylene, polypropylene, thermoplastic polyester, polypropylene terephthalate, polybutylene terephthalate, and polyvinyl chloride.

5. The packaging according to claim 1, wherein said least two slits are obtained from any one of molding and cutting out using a blade.

6. The packaging according to claim 1, wherein said at least two slits are adjoining, in a position with said cap mounted on said neck.

7. The packaging according to claim 1, further comprising a receptacle having an oval cross-section, and including a major axis and a minor axis, at least one of said at least two slits being oriented along said major axis of said oval cross-section of said receptacle.

8. The packaging according to claim 1, wherein said neck includes a free end provided with an external chamber.

9. The packaging according to claim 1, wherein said reservoir is made from any one of a thermoplastic material and a metal having flexibility, said metal being any one of aluminum and tin.

10. The packaging according to claim 9 wherein said metal is one from the group consisting of aluminum and tin.

11. The packaging according to claim 1, wherein said reservoir includes a bottom, formed by pinching and then thermowelding, of a free end of said compressible body.

12. The packaging according to claim 11, wherein at least one of said at least two slits is oriented along a line of closure of said compressible body.

13. The packaging according to claim 1, wherein said neck includes fixing means for cooperating with complementary means formed on said cap.

14. The packaging according to claim 13, wherein said fixing means of said neck includes a helical thread.

15. The packaging according to claim 13, wherein said neck exhibits a frustoconical exterior profile in cross section increasing in a direction of said reservoir, said cap exhibiting a complementary interior profile.

16. The packaging according to claim 13, wherein said complementary means of said cap includes a flared free end.

17. The packaging according to claim 1, wherein said shoulder includes at least one zone of preferential folding, said at least one zone of preferential folding including at least one zone of lesser thickness.

18. The packaging according to claim 17, wherein said at least one zone of preferential folding extends from at least one of said at least two slits, between said neck and a peripheral edge of said shoulder.

19. The packaging according to claim 17, wherein said at least one zone of preferential folding extends an the entire width of said shoulder.

20. The packaging according to claim 17, wherein said at least one zone of preferential folding is situated in a plane containing said at least two slits of said neck, which said at least two slits are diametrically opposed.

21. The packaging according to claim 17, wherein said at least one zone of preferential folding extends right around a base of said neck.

* * * * *

UNITED STATES PATENT AND TRADEMARK OFFICE

CERTIFICATE OF CORRECTION

PATENT NO. : 6,279,780 B1
DATED : August 28, 2001
INVENTOR(S) : Guilhem Rousselet It is certified that error appears in the above-identified patent and that said Letters Patent is hereby corrected as shown below:

Column 8,
Line 10, after "said" insert -- at --.
Line 56, change "an" to -- along --.

Signed and Sealed this

Eleventh Day of June, 2002

*Attest:*

*Attesting Officer*

JAMES E. ROGAN
*Director of the United States Patent and Trademark Office*